US006746522B2

(12) United States Patent
Trippe et al.

(10) Patent No.: US 6,746,522 B2
(45) Date of Patent: Jun. 8, 2004

(54) HIGH MOLECULAR WEIGHT POLYMER ADDITIVE FOR COATING AND PROTECTIVE PRODUCTS

(75) Inventors: Jerry C. Trippe, Fairfax Station, VA (US); Albert F. Hadermann, Ijamsville, MD (US); James A. Cole, Haymarket, VA (US)

(73) Assignee: GTAT, LLC, Virginia Beach, VA (US)

( * ) Notice: Subject to any disclaimer, the term of this patent is extended or adjusted under 35 U.S.C. 154(b) by 173 days.

(21) Appl. No.: 10/025,845

(22) Filed: Dec. 26, 2001

(65) Prior Publication Data

US 2002/0106454 A1 Aug. 8, 2002

Related U.S. Application Data

(63) Continuation-in-part of application No. 09/200,132, filed on Nov. 25, 1998, now abandoned.
(60) Provisional application No. 60/066,791, filed on Nov. 25, 1997.

(51) Int. Cl.[7] ..... C09G 1/14
(52) U.S. Cl. ..... 106/3; 106/11; 427/387
(58) Field of Search ..... 106/3, 11; 427/387

(56) References Cited

U.S. PATENT DOCUMENTS

| | | | | | |
|---|---|---|---|---|---|
| 3,729,415 | A | | 4/1973 | Davis et al. | 252/25 |
| 3,852,075 | A | * | 12/1974 | Basadur | 106/11 |
| 3,915,920 | A | | 10/1975 | Slovinsky et al. | 2601/29.6 RW |
| 3,919,098 | A | | 11/1975 | Altgelt | 252/59 |
| 3,977,979 | A | | 8/1976 | Crossfield et al. | 252/8.8 |
| 4,105,569 | A | | 8/1978 | Crossfield | 252/8.6 |
| 4,400,281 | A | | 8/1983 | Dehm | 252/8.6 |
| 4,436,846 | A | | 3/1984 | Krantz | 523/175 |
| 4,510,304 | A | | 4/1985 | Hadermann | 528/481 |
| 4,620,048 | A | | 10/1986 | Ver Strate et al. | 585/10 |
| 4,948,522 | A | | 8/1990 | Dunn et al. | 252/32.7 E |
| 5,030,591 | A | | 7/1991 | Cole et al. | 502/402 |
| 5,329,055 | A | | 7/1994 | Bachman et al. | 585/12 |
| 5,363,994 | A | * | 11/1994 | Angeline | 222/529 |
| 5,514,419 | A | * | 5/1996 | Popa et al. | 427/389 |
| 5,843,881 | A | | 12/1998 | Dubois et al. | 512/1 |
| 6,001,377 | A | | 12/1999 | SaNogueira, Jr. et al. | 424/401 |
| 6,462,009 | B1 | * | 10/2002 | Nagy et al. | 510/417 |
| 2003/0162683 | A1 | * | 8/2003 | Nagy et al. | 510/407 |

* cited by examiner

*Primary Examiner*—Anthony J. Green
(74) *Attorney, Agent, or Firm*—Dickstein Shapiro Morin & Oshinsky, LLP

(57) ABSTRACT

An ultrahigh molecular weight polymer, such as ultrahigh molecular weight polyisobutylene, is used as an additive to enhance the coating properties of a solvent. The polyisobutylene has a molecular weight of at least 2.5–3.0 million daltons, preferably greater than about 6 daltons, and is provided in a preferred concentration of 0.05 to 0.3%. The solvent can be a medicinal grade mineral oil. Other suitable solvents include hydrocarbon oil and low viscosity, synthetic compositions. In all cases, the coating properties of the solvent are greatly enhanced by the addition of ultrahigh molecular weight polyisobutylene. In another aspect of the invention, ultrahigh molecular weight polyisobutylene is used as an additive to enhance the viscoelasticity of a mineral oil based sunscreen formulation. In still another aspect of the invention, the fibers of a fabric material are coated with an ultrahigh molecular weight polymer to greatly strengthen the fabric. Other applications include improved automobile polishes and paint sealers, rust removers, and leather treatments.

4 Claims, No Drawings

HIGH MOLECULAR WEIGHT POLYMER ADDITIVE FOR COATING AND PROTECTIVE PRODUCTS

This application is a continuation-in-part of U.S. patent application Ser. No. 09/200,132, filed Nov. 25, 1998 now abandoned, which claims the benefit of U.S. Provisional Application Serial No. 60/066,791, filed Nov. 25, 1997.

BACKGROUND OF THE INVENTION

1. Field of the Invention

The present invention relates to coatings and, more specifically, to the use of an ultrahigh molecular weight polymer as an additive for coating and protective products.

2. Description of the Related Art

Polymeric additives, such as polyisobutylene, are known to improve certain properties of coatings. High molecular weight, however, is viewed as a liability because shear degradation can destroy qualities imparted to a coating by the polymer additive, especially when very low concentrations of polymer are used in the product. Moreover, ultrahigh molecular weight polymers, such as polyisobutylene, are exceedingly difficult to put into solution, especially in viscous hydrocarbon oils, at even very low concentrations, without excessive shear degradation. Thus, up to now, high concentrations of relatively low molecular weight polymers, such as low molecular weight polyisobutylene, have been used as coating additives.

SUMMARY OF THE INVENTION

The inventors have discovered, unexpectedly, that very low concentrations of ultrahigh molecular weight polymer, such as ultrahigh molecular weight polyisobutylene, serves as an excellent additive for coating purposes. For example, a medicinal grade mineral oil or other solvent can be transformed from a poor coating material to a much better than average coating material through the addition of less than one percent ultrahigh molecular weight polyisobutylene, and no other additives are required. Both the solvent and the polymer are nontoxic, and the resulting product likewise is nontoxic.

More specifically, the present invention is a method of using an ultrahigh molecular weight polymer, preferably ultrahigh molecular weight polyisobutylene, as an additive to enhance the coating properties of a solvent.

The ultra-high molecular weight polymer, preferably polyisobutylene, used in the present invention has a molecular weight of at least about 2.5–3.0 million daltons, preferably greater than about 6 million daltons, and is provided in a concentration in the final product of about 0.05 to about 5 percent. Commercially available ultrahigh molecular weight polyisobutylene, such as BASF Oppanol B-246 can be used, for example. Polymers useful in the present invention currently are being developed which have increasingly higher molecular weights, some in excess of 10 million daltons, and at least one has been developed with a molecular weight as high as 50 million daltons. Such polymers are expected to be commercially available, and are considered to be within the scope of the invention.

As stated above, the solvent can be a medicinal grade mineral oil. Other suitable solvents include hydrocarbon oil and synthetic compositions. In all cases, the coating properties of the solvent are greatly enhanced by the addition of ultrahigh molecular weight polyisobutylene.

In accordance with a second aspect of the present invention, a coating product is provided that contains a solution of a solvent of an ultrahigh molecular weight polymer, again preferably ultrahigh molecular weight polyisobutylene having a molecular weight and provided in the concentrations described above. Again, the solvent can be a medicinal grade mineral oil, a hydrocarbon oil or any synthetic composition.

In yet another aspect of the invention, an ultrahigh molecular weight polymer, preferably ultrahigh molecular weight polyisobutylene, is used as an additive to enhance the coating properties of a mineral oil-based sunscreen formulation. In still another aspect of the invention, the fibers of a fabric material are coated with an ultrahigh molecular weight polymer to greatly strengthen the fabric.

Additional examples of the present invention include, for example, metal, non-metal, rubber, ceramic, glass, fabric, and wood treatment products. The products are produced by dissolving high and ultrahigh molecular weight polymers, particularly polyisobutylene, in other solvents and additives.

Other features and advantages of the present invention will become apparent from the following description of the invention which refers to the accompanying drawings.

DETAILED DESCRIPTION OF THE PREFERRED EMBODIMENTS

Ultrahigh molecular weight polyisobutylene provided in a solvent in a range of concentrations from 0.05 to 5 percent has been found to confer coating properties to the solvent vehicle. The resultant solution is cohesive and exceptionally slippery. The cohesive nature imparted by the polyisobutylene transforms a non- or poor coating paraffinic solvent to a coating. Thus, in accordance with the present invention, non-coating materials, or materials that act poorly as coating, can be converted to coating materials by introducing very low concentrations of ultrahigh molecular weight polyisobutylene.

Since the polyisobutylene molecule conferring coating properties in a simple solvent is a non-vaporizing solid, the polymer remains on and in treated surfaces as a tough, durable, water-resistant, and on ferrous metals, rust-resisting film. By selecting suitable solvents and concentration of polyisobutylene, the residual film can be made to contain more or less residual solvent. In this way, the coating characteristics can be controlled. As one example emphasizing the fabric coating properties of the present invention, a bullet-proof vest can be strengthened by coating the fibers of the vest with ultrahigh molecular weight polyisobutylene.

Advantageously, products with enhanced coating properties formed by the addition of ultrahigh molecular weight polyisobutylene in accordance with the present invention can be water-white and clear and leave colorless transparent films.

Unlike glass, however, the films are stretchable and "self-healing" down to as low as −80° C. (below which the polyisobutylene molecules freeze). Above that temperature, the polyisobutylene molecules are free to move via snake-like "reptation."

Reptation motion, described in further detail below, assures interpenetration and cohesiveness of the intermolecular matrix, which cannot be cracked. Since the polyisobutylene molecules have a length-to-diameter ratio of 27,000 to 1, the high molecular surface area assures that many sites are available for attachment to other surfaces by adsorption. The small molecular diameter and the probing motion via reptation assure that these long molecules can penetrate nanometer-sized pores and cracks in metal, ceramic, wood, paper, leather, and rubber surfaces, resulting in vastly superior coating properties.

Since the phenomenon of reptation is believed to be at least partly responsible under certain conditions for the improved coating properties of the invention, a discussion of reptation is appropriate.

1. Reptation

Short chain saturated paraffin molecules are very small, both in length and width. Decane, for example, consists of a linear "snake" of two terminal $CH_3$ groups and eight $CH_2$ groups. The groups are connected via the overlap of hybrid $sp^3$ carbon atom orbitals. One characteristic of this mode of carbon-carbon bonding is free rotation about the backbone bonds. The absence of bulky side groups favors essentially unrestricted rotation. Another characteristic of the chemical structure is that neighboring bonds enclose an angle of approximately 109 degrees. At temperatures where decane is liquid, the molecule moves as a whole while the connected groups simultaneously rotate essentially independently of each other. This is a random dance of a moving molecule. As the center of mass of the decane molecule moves slowly, the ends of the molecule are more free than the inner links to "explore" space via reptation. A small molecule such as decane gets from point A to point B almost as a complete molecule. A very long polymer molecule, however, can get one of its ends from point A to a remote location at point B long before the center of mass moves very far. The free end of a long molecule can attach to a surface as an anchor for "reeling" in the remaining molecule (T. Fu et al., "Kinetics of polystyrene adsorption onto gold from dilute Theta solutions," *Macromolecules,* vol. 26, p. 3,271, 1993). The molecule is then adsorbed onto the surface.

In another recent experiment using pure polystyrene above its glass transition temperature, it has been conclusively proven that an entire molecule can move from one polymer film to another by reptation alone. Details of this experiment using films composed of deuterated polystyrene triblocks have been recently reported (T. P. Russell et al., "Direct observation of reptation at polymer interfaces," *Nature,* vol. 365, p. 235, 1993; R. P. Wool, "Reptating Chains at Polymer Interfaces," invited paper, Pittsburgh Meeting of the American Physical Society, Mar. 19, 1994; G. Agrawal et al., "Reptation at Interdiffusing Polymer Interfaces," *Macromolecules,* 1994). This movement of one molecule into another layer occurred through the polymer matrix entirely by reptation, as proven in the experiment.

Reptation is analogous to the movement of a long chain of boxcars along a track, i.e., there is only a narrow path available for the transfer of an enormous mass of material. Of all common polymers, poly-isobutylene (polyisobutene) has been found to be the most effective reptator in solution (D. J. Plazek et al., "Viscoelastic properties of amorphous polymers. 1. Different temperature dependencies of segmental relaxation and terminal dispersion," *Macromolecules,* vol. 25, p. 4,920, 1992). This is because the coupling constant for terminal dispersion of polyisobutylene is about equal to the coupling constant for segmental relaxation.

2. The Preferred Polyisobutylene for Reptation

Although there appear to be no current references to it with regard to reptation, the highest molecular weight polyisobutylene that is commercially available for the production of gels and solutions is Oppanol B-246 from BASF. The best commercial methods for the production of any concentration of this polyisobutylene in any solvent are set forth in U.S. Pat. No. 4,501,828, assignee to the present assignee, the disclosure of which is herein incorporated by reference.

Briefly, in accordance with the method of U.S. Pat. No. 4,501,828, using cryogenic processing, chunks of polyisobutylene readily convert to solutions or other composites with negligible degradation of molecular weight. By preserving molecular weight, the resulting solution and gel products are effective at even very low concentrations. This effectiveness appears as a consequence of the fact that the non-Newtonian behavior of such polyisobutylene products is a function of the square to the cube of the viscosity average molecular weight. In fact, the non-Newtonian behavior or viscoelasticity of such products increases more quickly with increasing molecular weight than does the Newtonian viscosity. This is important in applications requiring high viscoelasticity and low viscosity such as oil spill recovery, drag reduction, and fuel treatment.

It has been shown that the coating of surfaces via polymer solutions at the theta point demonstrates that low concentrations of higher molecular weight polymers is more effective than higher concentrations of lower molecular weight polymers (T. Fu et al., "Kinetics of polystyrene adsorption onto gold from dilute Theta solutions," *Macromolecules,* vol. 26, p. 3,271, 1993). Thus, polyisobutylenes of six million daltons or above are more effective coating agents and friction reducing agents than polyisobutylenes of lesser molecular weight.

A molecule of polyisobutylene can be visualized as a long chain of links which can individually undergo rotation through 360 degrees. However, the two $CH_3$ groups on every other carbon atom in the backbone assure that probing rather than folding motion predominates. Since all of this potential for expansion and free rotation exists, it is natural that the interior of the polyisobutylene molecule should assume a coiled-up spaghetti-like state when it is at thermal and mechanical equilibrium with its surroundings. The two free ends, however, can probe outwardly from the mass.

A six million dalton molecular weight polyisobutylene can be compressed or confined to a spherical volume with a diameter of approximately 0.027 microns. Completely stretched out, this molecule would extend 13.4 microns and its width would be approximately 0.00051 microns. The small molecular diameter illustrates the potential for the reptating ends of the molecule to penetrate into very small openings or to bond to surfaces. Furthermore, the potential to reptate long distances along closely conforming surfaces suggests a strong tendency for surface coating and bonding via Van der Waals exchange forces. The latter is of importance in the fields of corrosion inhibition and wear reduction.

Movement via reptation requires thermal energy alone; not shear or stretching forces. In a recent study of the interaction between polymer molecules at rest in solution and porous glass media, it has been shown that the molecules extend into the interstitial spaces of many grains via curvilinear extension (T. Fu, et al., "Kinetics of polystyrene adsorption onto gold from dilute Theta solutions," *Macromolecules,* vol. 26, p. 3,271, 1993). Higher molecular weight polymer molecules cover more interstitial liquid than lower molecular weight species. Thus, even low concentrations of high molecular weight polyisobutylene mixed with fine particulate matter make excellent penetrants and sealers.

Reptation of the ends of the polymer chain confers desirable qualities on coating formulations for many types of consumer and industrial products, as described in the examples below. Since reptation is powered by the automatic conversion of ambient thermal energy to mechanical motion (Brownian motion), it is not necessary to subject the formulations to shear, or to elongated stresses, to cause the polymer to spread into more space or volume. In fact, stretching out via reptation need not increase the apparent non-Newtonian viscosity, as does stretching via mechanically forced elongation.

Also, since reptation is tube-like motion, and the diameter of a polyisobutylene molecule is very small (on the order of $5\times10^{-8}$ cm), the molecule can cover significant distances in even the most confined spaces. Much larger confined spaces exist within journal bearings, pistons and cylinders, between the mating surfaces of nuts and bolts, and even between the monofilaments of the threads of textiles.

Furthermore, polymer spreading via reptation also occurs in an unconfined layer, such as a protective film applied to rubber, metal, glass or ceramic surfaces. A molecule which reptates down to a low glass transition temperature of −80° C., specifically polyisobutylene, is especially valuable in formulations for coating and protecting slowly and/or intermittently sliding surfaces under extreme environmental conditions. Furthermore, neighboring reptating polymer chains will become more intertwined, over long distances, than can occur within a mixture of similar but shorter polymer chains.

A long section of a molecule such as polyisobutylene is more likely to be cooperatively strongly attracted, via individually weak Van der Waals forces, to other reptating chains, or to solid surfaces. This is also a phenomenon favorable to coating formulations. Thus, once the polymer has been placed, wear can be prevented even if the Newtonian viscosity decreases.

In theory, polyethylene is optimal for rapid reptation at low temperatures. Unfortunately, polyethylene, which lacks bulky side groups on the polymer backbone, is not amorphous, but folded back on itself in crystallite regions. Van der Waals forces in these regions are very strong, and consequently polyethylene only becomes amorphous when heated above ambient temperatures. Polystyrene, on the other hand, is amorphous at ambient temperatures but is frozen into a glass, i.e., is usually at a temperature below its glass transition temperature. However, even at temperatures above its glass transition temperature, polystyrene has bulky benzene side groups along the polymer backbone. Consequently, it exhibits slower reptation relative to polyisobutylene at the same solution temperature.

3. Coating Applications

Uses for coating solutions containing ultrahigh molecular weight polyisobutylene include:

Water resistant coatings;

Tar cleaner and remover;

Metal polish, rust remover and protective metal coating;

Penetrant for stuck nuts and bolts;

Metal tubing coupling sealer;

Braided cable and weather resistant internal coating;

Anti-seize, anti-gall treatment for bolts;

Air tool line protectant;

Protective wood treatment;

Automobile polish and paint sealer;

Rust remover;

Leather treatment.

Advantageously, if ordinary medicinal mineral oil is used as the solvent, the above coatings incorporating ultrahigh molecular weight polyisobutylene are non-toxic and environmentally benign.

4. Fabric Strengthener

Ultrahigh molecular weight polyisobutylene can be used to improve the properties of high-strength textiles, non-woven webs, and knits. The high molecular weight polymer is provided in a solution which penetrates the multi-fiber threads of the textile, fabric, non-woven web, or knit. The tacky nature of the high molecular weight polymer assures both molecular entanglement and high strength adhesive coupling, of a noncovalent or nonionic nature, between the elastic coating and the coated fibers. Furthermore, the elastic matrix is continuous along the length of the thread, with the fibers imbedded in it, and the thread coated by it. The latter coating overlaps the other threads in the textile, and greatly restricts sliding induced by penetration of a sharp, wedge-like object. This composition strengthening effect is the mirror reflection of the well-known composite strengthening brought about by mixing high strength fibers in a polymer, ceramic, metal, or elastic material to improve the said nonfibrous material.

5. Bullet-Proof Vest Strengthener

Single fibers of ultrahigh molecular weight polyethylene, such as Allied Chemical's SPECTRA® can be woven to form a very tough, light weight, bullet-resistant fabric armor. Generally, such armor consists of about 37 layers of woven ultrahigh molecular weight polyethylene strands or threads. This armor withstands bullet impact due to the very high tensile strength of ultrahigh molecular weight polyethylene. However, sharp items, such as ice picks, can easily pass through the slippery polyethylene fibers. Moreover, ultrahigh molecular weight polyethylene tends to deform under impact, which may result in blunt trauma.

An improvement in the above-described body armor can be achieved by coating each of the several hundred polyethylene fibers with ultrahigh molecular weight polyisobutylene. After evaporation of the solvent, the tacky and elastomeric coating causes neighboring fibers in a thread to adhere to one another, rather than slip as in the untreated textile. The performance of a high strength fiber is further improved by the presence of ultrahigh molecular weight polyisobutylene in the natural void spaces between the fibers comprising a thread, and the overlap areas between contacting threads.

Upon interception of an object possessing high kinetic energy, the fibers transmit forces to the imbedding elastomer matrix, and these forces are absorbed by the viscous component of the viscoelastic polymer, dissipated and distributed among the other fibers in the thread. Also, the thread matrix resists deformation and separation.

Coating the polyethylene fibers with ultrahigh molecular weight polyisobutylene is carried out as follows. Powdered polyisobutylene is dissolved in a low viscosity solvent without degrading the molecular weight from a value of approximately six million daltons. The solution is settled overnight to remove insoluble substances and is then placed in a trough for treatment of the woven or non-woven ultrahigh molecular weight polyethylene sheet.

The solution solvent should be isoparaffinic and have an evaporation rate slightly greater than or less than that of water. One such liquid is Isopar G with a The armor vest preferably consists of layers of polyisobutylene coated and uncoated SPECTRA® fabric. This assures fabric flexibility, durability, comfort, and the best possible protection from impact, penetration, and blunt trauma.

Cost-effective and environmentally benign polyisobutylene/SPECTRA® processing can be assured through solvent vapor recapture and reuse. Solvent evaporation is forced in flowing nitrogen gas vented to a cryogenic solvent recapture system from either Air Products or Liquid Carbonics. Solvents suitable for this process are EXXON Isopar H, G, E and C. Isopar E evaporates slightly faster than water, while ISOPAR G is slightly slower. Isopar C dries about three times faster than water, while Isopar H is about ¼ as quick as water to evaporate. Isopar C would be used for very thick polyisobutylene deposits formed from 5 percent dopes. When layered, such sheets are effective against sharply pointed, penetrating objects such as ice picks and stilettos.

6. Improved Sunscreen

Although heavy mineral oil has been used as an internal medicine for many years, it is not used as a sunscreen for two reasons: 1) it is ineffective at absorbing or blocking UV; 2) it lacks body and film thickness.

The present invention uses heavy, medicinal mineral oil as a solvent for polyisobutylene (e.g. BASF's Oppanol B246) with a viscosity average molecular weight of about six million daltons.

The combination of the ultrahigh molecular weight polymer and the high viscosity mineral oil leads to a viscous and viscoelastic matrix which is an effective vehicle for homogeneously suspending sunscreen particles. Thus, the thickening effect of the polymer can be used to suspend very high levels, e.g., zero to 50 percent p-aminobenzoic acid and tocopherols, carotenes, or other products which absorb or block UV.

7. Wood Treatment Product

A wood treatment product was produced by dissolving three (3) grams of polyisobutylene with a viscosity average molecular weight of 7.2 million into 579 grams of odorless mineral spirits. This solution was blended with 193 grams of boiled linseed oil. The final product contained 3886 PPM of polyisobutylene. The wood treatment product was applied to a 3" by ½" cedar board. After allowing for drying a drop of water was applied to the surfaces of the treated and untreated sections of board and allowed to dry. There was a watermark on the untreated section and no watermark on the treated section.

8. An Automobile Polish and Paint Sealer

A solution of 60 grams of polyisobutylene with a viscosity average molecular weight of 7.2 million in 3006 grams of mineral spirits was added to a polish and paint sealer compound containing amino functional silicones at a dose rate of 200 ppm. The resulting composition was applied to painted metal tabs which were exposed to weather conditions along with painted tabs coated with unmodified polish and paint sealer. After six months exposure to weather the painted tabs coated with the polymer modified polish and paint sealer showed superior resistance to deterioration when compared to those coated with the unmodified polish and paint sealer.

9. Rust Remover

A solution of 0.56 grams of polyisobutylene with a viscosity average molecular weight of 7.2 million in 375 grams of Exxon's D-60 solvent, a high-flashpoint, aliphatic solvent, was applied to the oxidized surface of a carbon steel plate. Within five minutes the oxidized surface began to break down. A fine grain orange substance was formed on the surface of the metal. The orange substance was easily removed with a cloth.

10. Leather Treatment

A solution of 32 grams of polyisobutylene with a viscosity average molecular weight of 7.2 million in 3256 grams of a white oil, preferably a food grade oil such as Witco Chemical's Carnation mineral oil, was applied to the surfaces of a variety of leather products. The polymer solution penetrated the surface of the leather products in about thirty seconds leaving no trace of the solution. The resulting leather products were more supple and beaded water applied to the surface. In one example, the polymer solution was applied to the soles of leather shoes. It is estimated that the soles lasted 50% longer when treated with the polymer solution.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of providing an automobile polish and paint sealer, the method comprising the steps of forming a solution of ultrahigh molecular weight polyisobutylene in mineral spirits and adding the solution to a polish and paint sealer compound containing amino functional silicones, the ultrahigh molecular weight polvisobutylene having a molecular weight of at least about 2.5 million daltons.

2. The method of claim 1, further comprising the step of applying the automobile polish and paint sealer to automobile paint.

3. The method of claim 1, further comprising the step of applying the automobile polish and paint sealer to a painted metal surface.

4. A method of protecting a painted metal surface comprising: dissolving ultrahigh molecular weight polyisobutylene in mineral spirits to form a solution;

adding the solution to a polish and paint sealer compound containing amino functional silicones to form a composition; and applying the composition to the painted metal surface, wherein the ultrahigh molecular weight polyisobutylene has a molecular weight of at least about 2.5 million daltons.

* * * * *